US005667664A

United States Patent [19]

Juric et al.

[11] Patent Number: 5,667,664

[45] Date of Patent: Sep. 16, 1997

[54] LEDGE-FREE ALUMINUM SMELTING CELL

[75] Inventors: Drago D. Juric, Camberwell; Raymond W. Shaw, Woodend; Geoffrey J. Houston, Ashburton; Ian A. Coad, Kingsbury, all of Australia

[73] Assignee: Comalco Aluminum Limited, Melbourne, Australia

[21] Appl. No.: 709,629

[22] Filed: Sep. 9, 1996

Related U.S. Application Data

[63] Continuation of Ser. No. 243,075, May 16, 1994, abandoned, which is a continuation of Ser. No. 969,849, filed as PCT/AU91/00373 Mar. 26, 1993, published as WO92/03598 Mar. 5, 1992, abandoned.

[30] Foreign Application Priority Data

Aug. 20, 1990 [AU] Australia ..... PK1843

[51] Int. Cl.[6] ..... C25C 3/06

[52] U.S. Cl. ..... 205/372

[58] Field of Search ..... 205/372

[56] References Cited

U.S. PATENT DOCUMENTS

| | | | |
|---|---|---|---|
| 3,856,650 | 12/1974 | Kugler et al. | 204/243 R |
| 4,526,911 | 7/1985 | Boxall et al. | 523/445 |
| 4,592,820 | 6/1986 | McGeer | 204/243 R |
| 4,650,552 | 3/1987 | de Nora | 204/67 |
| 4,687,564 | 8/1987 | Blander et al. | 204/243 R |
| 5,043,047 | 8/1991 | Sledman | 204/67 |

OTHER PUBLICATIONS

Grjotheim et al; Aluminum Electrolysis Fundamentals of the Hall—Héeroult Process, 2nd Edition, p. 407, 1982 No Month Available.

*Primary Examiner*—Kathryn L. Gorgos
*Attorney, Agent, or Firm*—Nikaido, Marmelstein, Murray & Oram LLP

[57] ABSTRACT

An aluminium smelting cell comprising side walls (5) and a floor (2) defining an active cathode, an anode (3) overlying the cathode floor (2), some said side walls (5) being covered by a wetted cathode material (6), such as one contained $TiB_2$, so that the covered side walls become active cathode surfaces on which a film of aluminium metal forms to protect the side wall parts against bath attack, thereby enabling the cell to operate at the desired temperatures without the usual protective side ledge of the frozen electrolyte material.

3 Claims, 2 Drawing Sheets

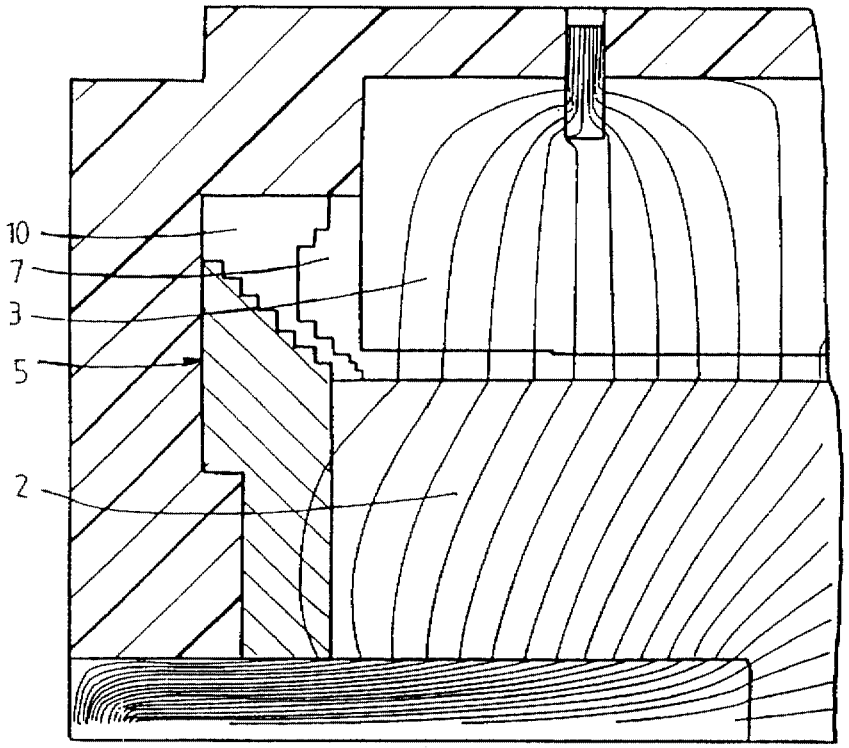
FIG. 3
FIG. 4
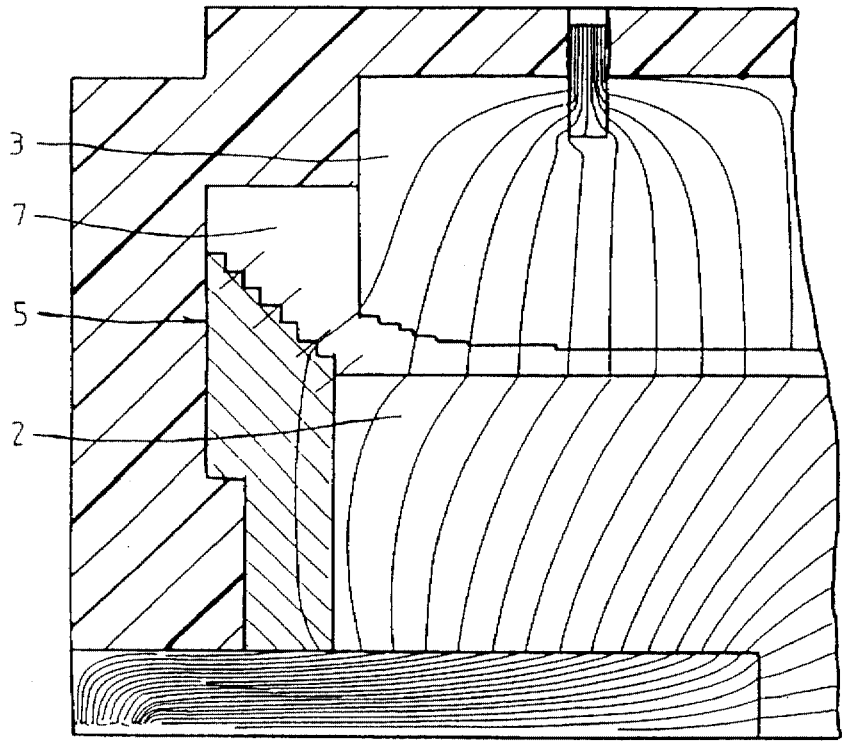

LEDGE-FREE ALUMINUM SMELTING CELL

This application is a continuation of application Ser. No. 08/243,075 filed May 16, 1994, now abandoned which is a continuation of application Ser. No. 07/969,849, filed as PCT/AU91/00373 Mar. 26, 1993 published as WO92/03598 Mar. 5, 1992, now abandoned.

FIELD OF THE INVENTION

This invention relates to improvements in aluminium smelting cells, and more particularly relates to an aluminium smelting cell which is capable of operation without the usual protective side ledge of frozen electrolyte material.

BACKGROUND OF THE INVENTION

The technical and patent literature relating to the construction and operation of aluminium smelting cells invariably supports the firmly entrenched belief that an aluminium smelting cell must operate with a stable ledge of frozen electrolyte material protecting the regions of the side wall of the cell contacted by the electrolyte bath and the molten aluminium produced thereby against the destructive action of the electrolyte and aluminium melts. For example in "Light Metals" 1979, Pages 475 to 492, Peacey & Medlin, describe the desirability of parameters of cell side wall design which promote the formation of a good ledge, while in "Light Metals" 1983, Pages 415 to 477, various authors, describe the factors necessary for the maintenance of a stable side ledge structure.

In the patent literature, the desirability of promoting an adequate side ledge is described in many prior art patents. For example, in U.S. Pat. No. 4,608,135 Brown uses artificial cooling of the side wall to induce the formation of an adequate side edge, while in U.S. Pat. No. 4,466,995 Boxall et al, describes a cell structure which controls the size of the side wall ledge but nevertheless indicates that the formation of such a ledge is essential.

Notwithstanding the widely recognized need for adequate ledge in the operation of known aluminium smelting cells, the advantages of operating a cell without a ledge are well understood but have not thus far been able to be achieved other than by substantial reductions in cell operating temperatures coupled with substantial modifications to the bath chemistry (see U.S. Pat. No. 5,006,209, Beck et al).

SUMMARY OF INVENTION AND OBJECTS

It is the object of the present invention to provide modifications to the aluminium smelting cell structure which enable operation of the cell without a ledge while being able, if desired, to maintain standard operating temperatures and bath chemistries.

The invention provides an aluminium smelting cell comprising side walls and a floor defining an active cathode, at least one anode in overlying relationship with said cathode floor, characterized in that at least a part of each side wall of said cell is covered by means of a wetted cathode material, the or each anode having portions which are adjacent said covered parts of said side walls whereby said side wall parts become active cathode surfaces of the cell on which a film of aluminium metal will form to protect the side wall parts against erosion.

In a preferred form of the invention, the side walls of the aluminium smelting cell should be covered by said wetted cathode material to a height at least corresponding to the expected height of the cell bath. In this way, the need for the establishment of a protective ledge in the cell may be substantially avoided whereby the heat balance of the cell can be more easily controlled.

The elimination of the frozen side ledge means that there is an increased volume of molten bath available for dissolution of alumina. This helps to decrease the risks of anode effects which, in turn, reduces the related voltage, thermal imbalance and cell control penalties.

The shape of the side ledge influences the shape of the cell metal pad reservoir (in the case of an undrained cathode cell) through the altered current pathways caused by its insulating presence. The elimination of the ledge leads to a more predictable and consistent current distribution and therefore metal pad profile, which in turn allows a more precise anode to cathode distance to be set and controlled.

The voltage benefit to be gained by a lower current density cell operation requires a more heavily insulated cell to compensate for the lower heat generation. These benefits would be severely restricted, or unobtainable, if it were also necessary to maintain a frozen side ledge through under-insulation or forced cooling of the side wall.

BRIEF DESCRIPTION OF THE DRAWINGS

In order that this invention may be more readily understood, a preferred embodiment of the invention will now be described with reference to the accompanying drawings in which:

FIG. 3 illustrates the 5% current distribution lines of a standard aluminium smelting cell operating with a side wall of frozen electrolyte;

FIG. 4 is an illustration similar to FIG. 4 showing the 5% current distribution lines for a cell embodying the present invention.

DESCRIPTION OF THE PREFERRED EMBODIMENT

Figure 1:
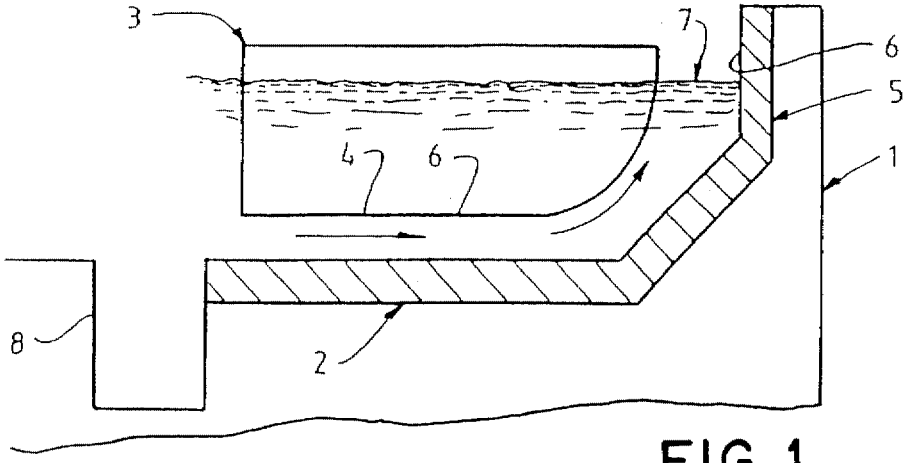
FIG. 1 is a schematic sectional end elevation of an aluminium smelting cell embodying the present invention.

Referring firstly to FIG. 1 of the drawings, the aluminium smelting cell 1 embodying the invention is shown schematically to include a floor portion 2 defining an active cathode, an anode 3 having an active surface 4 overlying the cathode 2, and a side wall 5 extending angularly and upwardly from the floor portion 2 in the manner generally shown in FIG. 1. In the present embodiment, the floor portion 2 and the side wall 5 are covered by means of a wetted cathode material 6, such as a $TiB_2$ containing compound known in the art. The wetted cathode material 6 is shown as extending to the top of the side wall 5, although in practice it is only necessary for the material to extend to a height equal to or slightly above the height at which the molten bath 7 of the cell is known to extend.

In the embodiment shown, the cell is of horizontal drain construction having a central sump 8 for collecting the molten metal from the surface of the cathode 6. However, the covering of the side wall 5 with a wetted cathode material may be applied to any cell construction to provide the advantages of ledge-free operation.

It will be appreciated that by covering the lower side wall fillet or ram and the upper side wall portion with a wetted cathode material, and keeping them ledge-free, these surfaces form part of the active cathode surface on which a film of aluminium metal will form. This results in the following advantageous cell features:

(i) Depending on the proximity of the anode, the near side edge of the anode can be induced to burn to the desired profile to facilitate the controlled release of bubbles described earlier, as well as encouraging sufficient induced bath flow along the length of the anode to yield a good alumina supply into the ACD.

(ii) The active metal-covered sidewall is thus made more resistant to bath attack and the need for maintaining a protective sidewall ledge is removed. Ledgeless cell operation reduces the need for very stringent heat balance controls, increases the available bath volume in the cell and provides increased control flexibility.

Figure 2:
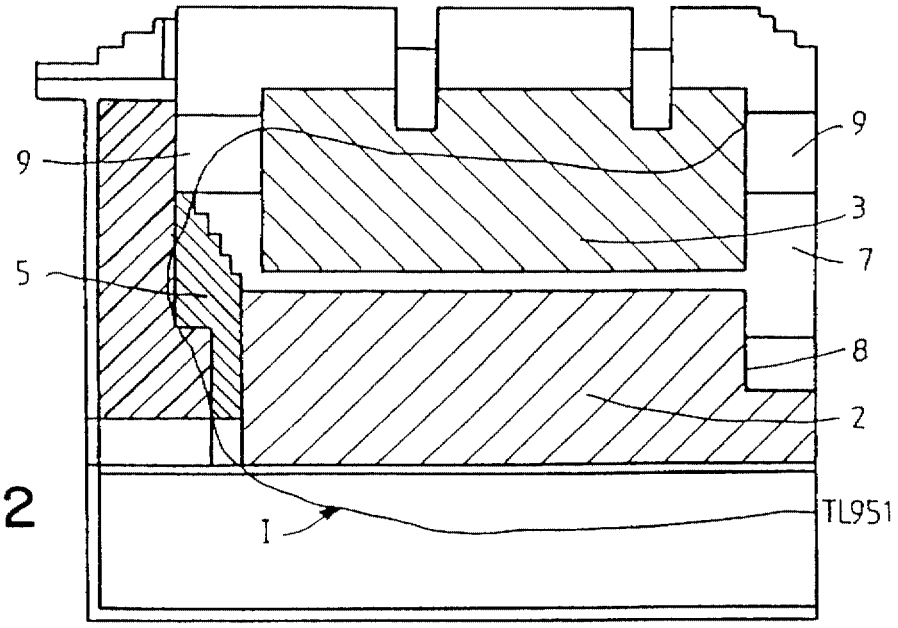
FIG. 2 illustrates an example of the location of the liquidus point isotherm in a drained cathode cell embodying the present invention.

FIG. 2 of the drawings shows that by appropriate cell design and use of insulation the liquidus point isotherm I in a cell embodying the present invention lies outside the active region of the cell and intersects the side wall 5 at the point of intersection of the side wall and the crust 9 which forms over the bath in operation.

FIGS. 3 and 4 of the drawings illustrate the 5% current distribution lines in a standard cell (FIG. 3) and in a cell embodying the present invention (FIG. 4). In FIG. 3, the frozen side ledge which traditionally forms is illustrated at 10. It will be noted that the anode 3 substantially retains its original essentially rectangular configuration at the edges, and there is little anode profiling of the type referred to above. This leads to an increase in the bubble layer resistance beneath the anode thus increasing the operating voltage of the cell.

FIG. 4 of the drawings clearly shows that the wetted cathode material covered side wall 5 is active and will, therefore, be covered by a thin film of molten aluminium which in turn protects the side wall against bath attack. The current densities in the regions A to D shown in FIG. 4 were found to be of the order of 0.2 $A/cm^2$, while the current density in the main cathode region was of the order of 0.7 $A/cm^2$. At the above relative cathode current densities, metal should be deposited on the surface of the side wall 5 at approximately one-quarter of the rate of metal production on the bulk cathode. Further molten metal may be provided by surface tension driven flow of metal from the cathode region up the side wall. Accordingly, the current passing through the side wall 5 is sufficient to generate the formation of an aluminium metal film covering the side wall to provide protection from attack by the molten electrolyte 7. Furthermore, since the side wall 5 is active, the anode 3 is profiled as shown in FIG. 4 to provide for controlled release of bubbles from beneath the anode 3 which lowers the bubble layer resistance beneath the anode 3 and consequently reduces the operating voltage of the cell.

In order to achieve ledge-free operation in the side wall regions, additional insulation will be required in the side wall structure, and the super heat of the cell will increase to probably greater than 20° C. High energy efficiency can be achieved whilst operating at high bath super heat, and these conditions also promote good alumina dissolution which minimizes sludge formation. This may enable the cell electrolyte to be significantly modified so that electrolytes with very much lower melting (and, therefore, operating) point temperatures may be used, for example, from 950° C. to about 850° C. Such a reduction in cell electrolyte temperature will reduce the cell heat loss by approximately 10% and should thereby increase the energy efficiency by about 5%. Ledge-free cell operation will also result in an increased electrolyte volume which will permit enhanced alumina dissolution and thereby result in smaller alumina concentration swings between alumina additions.

It will be appreciated from the above that the elimination of the frozen side wall ledge provides for greater latitude, flexibility and simplicity in cell operation. The substantial heat extraction required to form the frozen side ledge results in thermally inefficient cell operation, and the absence of the need for a ledge significantly improves thermal efficiency. Similarly, the present of a side ledge constrains the temperature of the electrolyte to values very close to its liquidus point, usually about 5° to 10° C. above it. This low level of super heat imposes restrictions on the dissolution of alumina in the bath and the consequential formation of sludge. As mentioned above, elimination of the side ledge allows larger super heat values to be employed, and this provides a corresponding benefit in alumina dissolution capability and reduction in sludge formation. Furthermore, since the frozen side ledge is usually pure cryolite, whilst the molten electrolyte is a closely controlled mixture of components, the dynamic freezing and remelting of the side ledge leads to variations in the bath composition and difficulties in maintaining stable bath composition. The absence of the side ledge will provide consequential improvements in the stability of bath composition.

Figure 5:
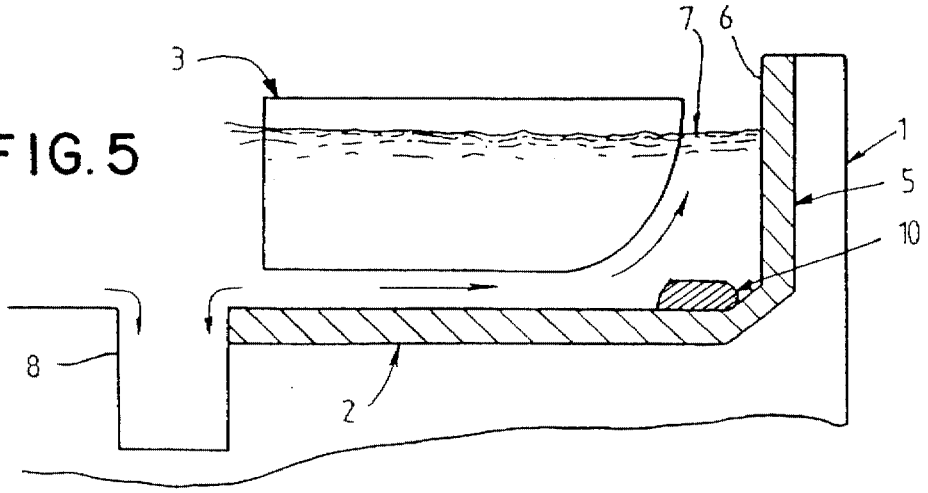
FIG. 5 is a schematic sectional end elevation of an alternative cell configuration embodying the present invention.

In the modified cell design of FIG. 5 of the drawings, the lower side wall fillet or ram is supplemented by an abutment or protrusion 10 formed on the surface of the cathode 2 adjacent the side wall 5. The abutment is preferably covered by means of a wetted cathode material similar to the material 6 which covers the side wall 5 and the cathode 2 and operates to cause specific profiling of the edge of the anode 3, in the manner illustrated in FIG. 5, as well as inducing bath flow to ensure a good supply of alumina-enriched bath into the electrolysis zone. In all other respects, the operation of this embodiment is similar to the operation of the embodiment of FIG. 1.

The cell designs described above may be modified to suit any given set of circumstances and may incorporate any one of the design features described in greater detail in our co-pending Patent Application of even date herewith entitled "Improved Aluminium Smelting Cell", which claims priority from Australian Patent Application No. PK 1843 dated 20th Aug. 1990. Similarly, the cell may incorporate any one of the design features described in greater detail in our co-pending Patent Application No. Au-A 50008/90 or in corresponding U.S. Ser. No. 07/481847 Stedman et al, filed Aug. 27, 1991, now U. S. Pat. No. 5,043,047.

We claim:

1. A method of operating an aluminum smelting cell wherein said cell comprises an anode, cathode side walls, a cathode floor, and means to supply an aluminum producing current to said cell, the method comprising the steps of:

(a) disposing a layer of aluminum wettable cathode material on at least a portion of said cathode side walls and said cathode floor;

(b) providing an aluminum producing electrolyte in said cell;

(c) disposing said anode proximate to said cathode side walls and said cathode floor to cause a current to be established between said anode and said cathode side walls while maintaining a current between said anode and said cathode floor;

(d) passing current through said anode and said cathode side walls and said cathode floor to produce molten aluminum at said cathode side walls and said cathode floor;

(e) forming a protective layer of molten aluminum on said cathode side walls to protect said cathode side walls against attack by electrolyte, said protective layer present at least when current densities at said cathode side walls and said cathode floor are apportioned to produce molten aluminum at said cathode side walls at about one quarter of the rate of the aluminum produced at said cathode floor;

(f) maintaining said cathode side walls substantially free of frozen electrolyte; and (g) recovering said aluminum from said cell.

2. The method of claim 1 including apportioning the current densities at the cathode side walls and the cathode floor in a ratio of about 1:4.

3. The method of claim 1 including apportioning the current densities at the cathode side walls and the cathode floor in a ratio of about 0.2 $A/cm^2$ to about 0.7 $A/cm^2$.

* * * * *